US006209717B1

(12) United States Patent
Flynn

(10) Patent No.: US 6,209,717 B1
(45) **Date of Patent: *Apr. 3, 2001**

(54) HUMIDITY CONTROL SYSTEM FOR MUSICAL INSTRUMENT

(75) Inventor: Timothy R. Flynn, Elkhorn, WI (US)

(73) Assignee: GWW, Inc., Elkhorn, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/963,330

(22) Filed: Nov. 3, 1997

(51) Int. Cl.[7] ..... A45C 11/00
(52) U.S. Cl. ..... 206/204; 206/213.1; 206/314
(58) Field of Search ..... 206/14, 314, 204, 206/205, 213.5; 84/453; 312/31, 31.01–31.06, 31.1–31.3

(56) References Cited

U.S. PATENT DOCUMENTS 3,719,033 * 3/1973 Den Boer ..... 84/453
3,721,152 * 3/1973 Von Meyer ..... 84/453
4,192,773 * 3/1980 Yoshikawa et al. ..... 206/205
4,263,951 * 4/1981 Siegel ..... 150/113
4,428,892 * 1/1984 Berliner ..... 312/31.01
4,649,793 * 3/1987 Blackshear et al. ..... 84/453
4,674,630 6/1987 Kirck ..... 206/205
5,219,075 6/1993 White ..... 206/314
5,607,051 3/1997 Espinosa ..... 206/213.1
5,803,247 * 9/1998 Holmes et al. ..... 206/213.1
5,934,773 * 8/1999 Ferrell ..... 312/31.1
5,936,178 * 8/1999 Saari ..... 84/453

* cited by examiner

*Primary Examiner*—Jim Foster
(74) *Attorney, Agent, or Firm*—Brown, Pinnisi & Michaels, P.C.

(57) ABSTRACT

A humidity control system for a musical instrument case includes at least two compartments venting into the inside of the case. At least one of these compartments is fitted for a desiccant pouch, with at least one compartment alternatively used and fitted for a humidifier. The use of more than two compartments (e.g., more than one humidifier or desiccant) may be occasioned by an extreme local atmosphere or an exceptionally large instrument or both. A hygrometer and a thermometer are preferably provided with the case to enable a musician to easily ascertain the environmental conditions inside the case. The musician then adds either the desiccant pouch or activates the humidifier in the appropriate compartment of the carrying case, as necessary. The compartments can be built into the case or fastened using conventional fasteners such as adhesive or snaps.

7 Claims, 3 Drawing Sheets

HUMIDITY CONTROL SYSTEM FOR MUSICAL INSTRUMENT

FIELD OF THE INVENTION

The present invention relates generally to articles for containing, storing, and transporting musical instruments which are capable of providing a humidity-controlled atmosphere, and specifically, to a humidity control system included as a component of a musical instrument carrying case.

BACKGROUND OF THE INVENTION

The environment in which a musical instrument is stored affects the reliability, sound, condition, and lifespan of that instrument. Musical instruments are typically stored in containers that are designed to be both easily portable and protective against environmental hazards such as wind, rain, dust, sand, and sun. However, conventional instrument cases are not built with the capability to protect instruments from the ongoing hazards of temperature and humidity, either high or low.

The presence or absence of atmospheric humidity, in particular, can affect the is lifespan and sound of many musical instruments, among them stringed, woodwind, brass, and percussion instruments. According to *Making Musical Instruments* by Irving Sloane, all instruments, stringed instruments in particular, are best built in a dry atmosphere. For example, a fiddle constructed in an atmosphere of about 65% relative humidity is likely to crack if moved to an area of 20% or less relative humidity. Since the converse does not hold true, instrument makers generally build instruments in a relatively dry environment, typically about 40%–45% relative humidity. In this way, they enable the instruments they construct to survive the normal extremes of humidity that a given instrument might encounter over time.

Though this type of precaution is taken in construction, the presence or absence of humidity, whether in the form of excessive moisture or of extreme dryness, can cause swelling, splits, cracks, checking, movement in glue joints, and distortion of woods or other materials in a given instrument. Any of these problems can damage or destroy an instrument. Potentially the most damaging situation in which an instrument, susceptible to changes in humidity, can be put is in an excessively humid atmosphere, coupled with rapid changes in temperature. This situation can easily cause permanent damage to an instrument, and often occurs when an instrument is transported from one location to another.

Though the prior art has in some ways recognized these problems, the solutions provided, as seen below, do not go far enough in an effort to protect valuable musical instrument from the depredations of temperature and humidity.

U.S. Pat. No. 4,674,630 (to Kirck) discloses a portable, self-enclosed reed case that maintains an environment most conducive to the reeds used in woodwind instruments. Kirck is silent regarding protecting the instruments themselves.

U.S. Pat. No. 5,219,075 (to White) discloses a musical instrument case cover that includes foam and plastic materials that retard the effects of the environment encountered outside the case itself The case provides protection for about five hours in extreme conditions and for about twenty-four hours in less extreme conditions. An important drawback to the White invention is that it seeks to maintain the ambient conditions prevailing at the time the case is closed. Thus, if the ambient conditions, at the time of closure, consist of extreme moisture and heat, these conditions are preserved within the case.

From the above, it appears that a long-felt need in the field has been for a device capable of allowing a musical instrument owners to consistently control and monitor the ambient temperature and humidity of the atmosphere in which the store, transport, or carry their instruments. Such a device would preferably allow the owner to control the atmospheric challenges of humidity and temperature generally encountered, thereby protecting the instrument for an extended period.

SUMMARY OF THE INVENTION

In accordance with the present invention, an improved storage case for musical instruments is disclosed, which provides a humidity control system for a musical instrument carrying case. The invention includes at least two compartments venting into an inside portion of the case where a stored instrument is placed. Of these compartments, at least one is fitted for a desiccant pouch, likewise at least one of the other compartments is fitted for a humidifier. The number of compartments can vary by the size of the instrument or the needs an owner may have for protecting their instrument in a given local environment, typically two compartments are used, with one for the desiccant and one for the humidifier. Once the owner or caretaker determines the atmospheric conditions inside the case, a desiccant pouch can be added, or the humidifier engaged, in the appropriate compartment(s), as necessary.

The storage case of the present invention is typically used to maintain a constant relative humidity range between 45% and 55% but can be altered according to the needs of the instrument owner. These storage conditions work to maintain and protect the physical integrity of the instrument when stored, transported, or moved in the disclosed carrying case, thereby extending the lifespan and performance quality of the instruments so protected.

In one embodiment of the invention, a hygrometer is provided within the case in order to measure relative humidity.

In another embodiment a thermometer may be supplied to measure temperature within the carrying case.

In another embodiment of the invention, both the thermometer and the hygrometer are present as a part of the invention disclosed herein. These devices are preferably provided to enable the owner or caretaker of an instrument too easily to ascertain the environmental conditions in which the instrument in question has been placed. While both the thermometer and the hygrometer monitor the interior atmosphere of the instrument carrying case when it is sealed, the information provided by these devices may alternately be read only when the carrying case is open or the gauges may be constructed so that they can be read from the outside of the carrying case when it is closed.

In another embodiment of the invention disclosed herein at least one handle is securely attached to the exterior of said carrying case, to provide an ease in carrying said case.

In yet another embodiment of the invention the compartments adapted for the insertion of either the desiccant pouch or the humidifier are themselves releasably attached to the interior of the case by a fastening means. In this embodiment the compartments still vent into the interior of the carrying case, but said compartment(s) could be removed from the carrying case dependent upon the desires of the case owner. For this embodiment the fastening means could include Velcro, snaps, straps, adhesive, screws, bolts, & pegs.

According to an embodiment of the invention, a storage apparatus for a musical instrument includes carrying means for carrying the musical instrument, and humidity control means attached on an inside of the carrying means for controlling humidity inside the carrying means.

According to an embodiment of the invention, a humidity control unit for a musical instrument carrying case includes control means attachable on an inside of the carrying case for controlling humidity inside the carrying case, and attachment means for attaching the control means to the carrying case.

DESCRIPTION OF THE PREFERRED EMBODIMENT

Figure 1:
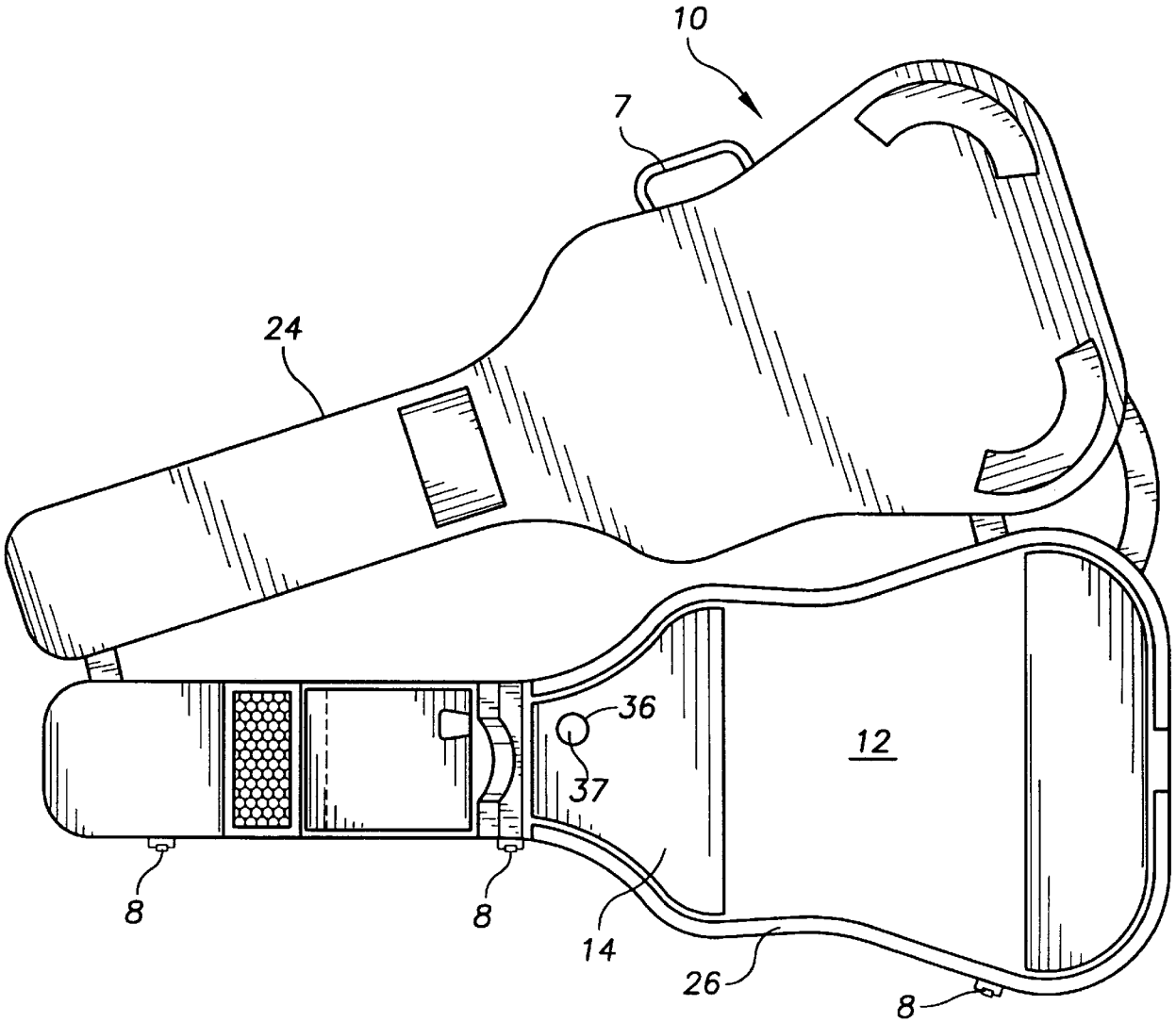
FIG. 1 shows a guitar case with an embodiment of the present invention installed therein.
Figure 2:
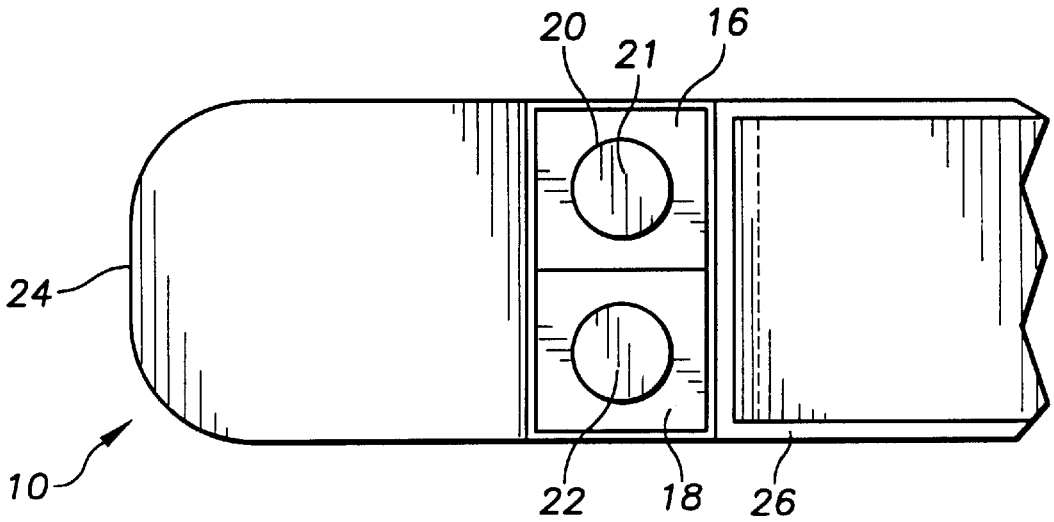
FIG. 2 shows humidifier and desiccant compartments and their location within the instrument carrying case according to an embodiment of the present invention.

Referring to FIGS. 1–2, reference numeral 10 generally designates a instrument carrying case, having a handle 7, variously designed to receive a plurality of musical instruments in an internal compartment 12 with an inside surface 14 adapted to receive a musical instrument (not shown). Case 14 is generally kept closed with a plurality of fasteners 8. FIG. 1 depicts a guitar case, but a case designed for any instrument could also be adapted for the humidity control system of the present invention.

Reference numerals 16 and 18 generally designate two compartments adapted to receive a humidifier 20 and a desiccant filled pouch 22. It should be noted that alternative embodiments of the invention envision the use of more than two compartments (e.g. 16 or 18), as needed by the instrument owner. In this description then, two compartments 16 and 18 are used for the sake of simplicity. The carrying case 10 has an inside surface 14, which is smaller than an outer surface 24, and forms a lip 26 therewith. The lip 26 preferably forms a humidity impermeable seal. The inside surface 14 tends to conform to the particular cut or curvature of the individual instrument for which the carrying case 10 is designed.

Compartment 16 is adapted to receive humidifier 20, which operates to maintain the relative humidity of the inside surface 14 and the instrument placed therein when said instrument is stored, transported, or moved in the carrying case 10.

The stability of the carrying case 10 environment is controlled by the owner or caretaker of the instrument carrying case as follows. When the case humidity is above 65% the owner inserts a desiccant pouch 22 into a designated compartment 18 within the case and removes the humidifier 20 from the other compartment 16. Alternatively the humidifier 20 can be left in the carrying case 10 but not recharged with water. When the humidity within the case is below 35%, or the atmospheric conditions are dry, the desiccant pouch 22 is removed from its compartment 18, and the humidifier 20 is returned to its designated compartment 16. The most preferable humidity range to maintain within the interior of the carrying case 10 is 45% to 55% humidity. When these alternative strategies, used according to locale ambient humidity, are used, a stable environment is created and maintained for the musical instrument to be protected. In addition, the owner of the case retains the flexibility to select the exact desired humidity for their instrument by manipulating the amount of desiccant used, or controlling the recharging of the humidifier 20.

The humidifier 20 consists of a container that preferably holds a clay 21 capable of absorbing moisture and thereafter slowly releasing it. "Clay" is used with its usual meaning as defined in *Compton's Interactive Encyclopedia* copyrighted by Compton's NewMedia, Inc. In the instant disclosure, a clay is the preferred compound to act as the humidifier. Clay is a generic term, which essentially refers to a number of species of fine-grained earths, plastic when wet, composed chiefly of hydrous aluminum silicate minerals. As is well known a variety of clays are used in the manufacture of brick, pottery and other ceramics. With respect to the use of clay as the chief component of the humidifier disclosed herein, the inventors rely upon the intrinsic nature of clay, when wetted, to retain moisture and give it up slowly. In this way a fully "charged" (e.g., charged by immersion in water) humidifier contains a significant amount of water which will be emitted slowly over time to inject moisture into an otherwise dry atmosphere, acting to maintain a relative humidity in the range most desired to preserve musical instruments.

To initially charge humidifier 20, humidifier 20 is immersed in water, a cap (not shown) is then closed, excess water is wiped off, and humidifier 20 is returned to the case 10.

Desiccant pouch 22 preferably contains any one of a plurality of anhydrous compounds or compounds capable of absorbing moisture from the ambient air such as a buffered silica gel or a saturated salt solution. When exposed to an environment that contains significant moisture, the selected anhydrous substance absorbs moisture and in this way removes it from the local environment inside the instrument case 10 disclosed herein.

Compartments 16 and 18 can also be releasably attached to the interior surface 14 of the case 10. Fastening means such as clips, snaps, Velcro, or bolts would be employed to secure compartments 16 and 18 into the interior surface 14 of case 10.

Figure 3:
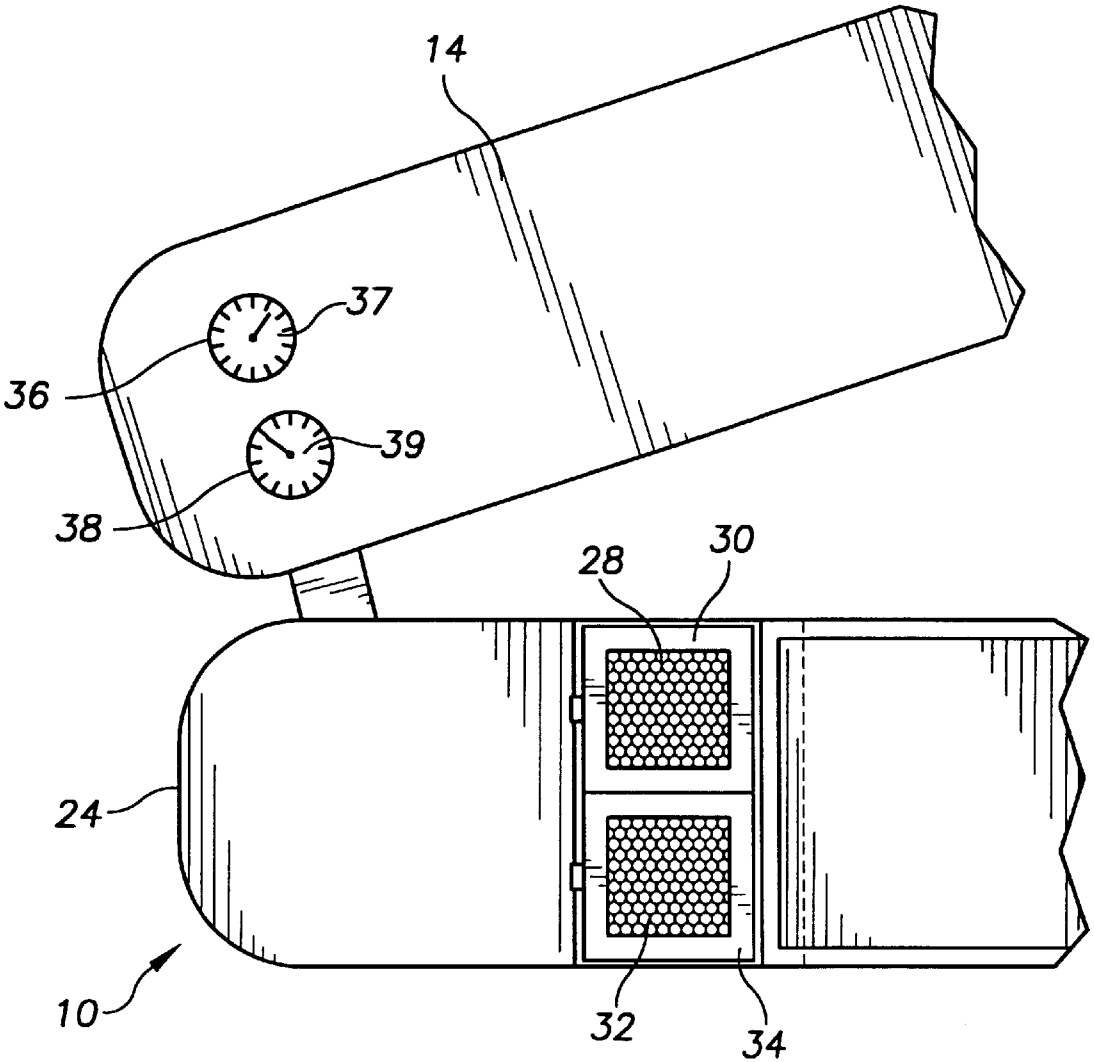
FIG. 3 shows a thermometer and hygrometer according to an alternate embodiment of the invention.

Referring to FIG. 3, a plurality of air passages 28 in a partition 30 are small enough to retain the humidifier 20 in compartment 16 while allowing for free vapor exchange between the inside of case 10 and the humidifier 20. Likewise, a plurality of air passages 32 in a partition 34 are small enough to retain the desiccant 22 in compartment 18, while allowing for free vapor exchange between the inside of case 10 and the desiccant pouch 22. Compartments 16 and 18 can include opening and closing means such as hinges 33 to enable access to the desiccant or humidifier.

FIG. 3 also shows an alternative embodiment of the present invention which permits the temperature of the interior of the carrying case 10 to be monitored through the presence of a thermometer 36, whose gauge 37 is present in the inside surface 14 of the carrying case 10. Alternately, the carrying case 14 is constructed so that the gauge 37 of the thermometer 36 is readable from the exterior of carrying case 10 when said case is closed.

In another embodiment, the humidity of the interior of the carrying case 10 is monitored through the presence of a hygrometer 38, whose gauge 39 is present in the inside surface 14 of the carrying case 10. Alternately, the carrying case 14 is constructed to that the gauge 39 of the hygrometer 38 is readable from the exterior of carrying case 10 when the case 10 is closed.

In embodiments of the invention containing the hygrometer 38, the owner of the carrying case 10 (also an instrument storage apparatus) can use it to monitor the internal humidity of the case 10 and maintain the humidity for any geographic location in which the owner is located or through which the owner is travelling.

The preferred desiccant will be one in which the composition thereof will contain at least 40% silica gel with the balance being composed of activated charcoal. Silica gel is a colloidal suspension of silicic acid made by dialysis from action of hydrochloric acid on water glass; when dried to 5% water, it resembles coarse sand and absorbs gases, especially water vapor, readily. The activated charcoal also functions to reduce or remove odors occurring within the case. Preferably, the silica gel makes up 60% of the desiccant mixture with activated charcoal. In addition, it is also preferred that the activated charcoal is derived from processed coconut husks, since this source appears to have superior capabilities in the reduction of odors.

With regards to the silica gel used as a desiccant within this disclosure, it is known that buffered silica gels can be used to regulate relative humidity. Silica gel will absorb a known amount of water within a particular relative humidity range. Thus, when initially developed a given mixture of desiccant containing silica gel can be conditioned to maintain or retard movement away from a target relative humidity in a given local atmosphere, as within a closed instrument case.

Figure 4:
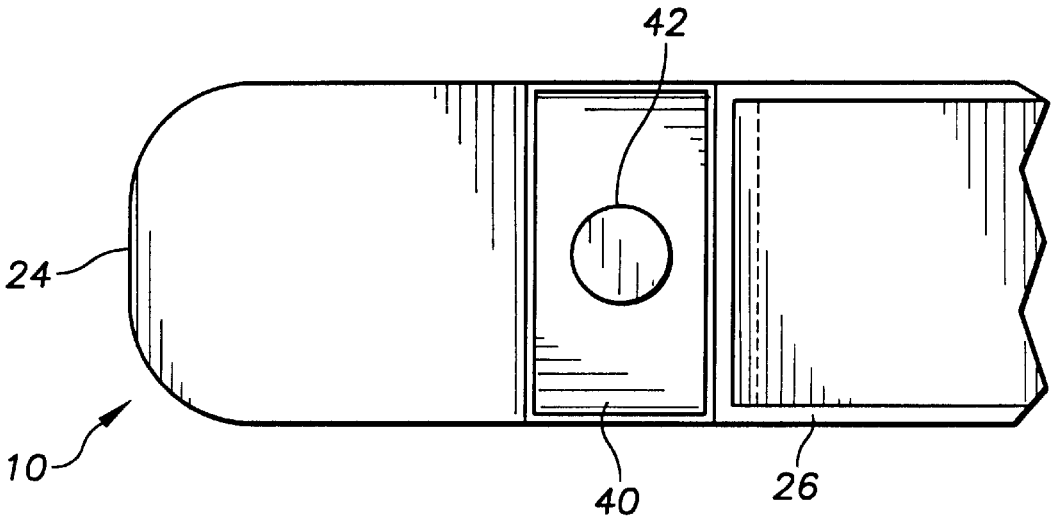
FIG. 4 shows a single compartment containing a solution of saturated salts according to an embodiment of the invention.

Referring to FIG. 4, an alternative embodiment uses only one compartment 40 having a container 42 with a saturated salt solution therein, which can be used as both a desiccant and humidifier to control and maintain the relative humidity in an instrument carrying case. Saturated salt solutions will supply water vapor to a maintain a target relative humidity as long as any undissolved salt remains. Saturated salts can absorb close to 100% of their volume in water. Once absorbed this solution can then allow desorption of 100% of total water trapped by the salt solution. The result is that the salt crystals employed as a desiccant can in fact contribute to the maintenance of a given relative humidity, and require less relative maintenance than a silica gel desiccant. Species of salt formulations useful for this purpose are nitrate salts such as calcium, sodium, or magnesium nitrate. Alternative salts which are also useful at the relative humidity ranges that should be maintained for instrument storage are sodium dichromate, or potassium carbonate.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A storage apparatus for a musical instrument, comprising:

carrying means for carrying said musical instrument;

humidity control means attached on an inside of said carrying means for controlling humidity inside said carrying means;

temperature measuring means connected to said carrying means for measuring a temperature inside said carrying means; and humidity measuring means connected to said carrying means for measuring humidity inside said carrying means.

2. A storage apparatus according to claim 1, wherein said humidity control means includes only one compartment containing a salt compound selected from the group consisting of calcium nitrate, sodium nitrate, magnesium nitrate, sodium dichromate, and potassium carbonate.

3. A storage apparatus according to claim 1, wherein said humidity control means includes first compartment means for containing a humidifier and second compartment means for containing a desiccant.

4. A storage apparatus for a musical instrument comprising:

a) a musical instrument carrying case; and b) a humidity control unit attached to an inner portion of said musical instrument carrying case, said humidity control unit including:

i) a first compartment capable of holding a humidifier, and ii) a second compartment capable of holding a packaged desiccant;

c) at least one humidifier that is capable of being inserted within said compartment;

d) at least one packaged desiccant that is a compound that is capable of absorbing moisture from the internal environment of said storage apparatus, said packaged desiccant being held in a container which does not prevent said compound from removing moisture from the interior of said musical instrument carrying case and is a mixture of silica gel and activated carbon, such that the silica gel comprises at least 40% of said mixture; and wherein said at least one humidifier and said at least one packaged desiccant can be inserted and removed from said first and second compartment respectively by a person to maintain a stable and desired relative humidity inside said musical instrument carrying case.

5. The storage apparatus of claim 4 wherein said activated carbon is generated from the shells of coconuts.

6. A storage apparatus for a musical instrument comprising:

a) a musical instrument carrying case; and b) a humidity control unit attached to an inner portion of said musical instrument carrying case, said humidity control unit including:

i) a first compartment capable of holding a humidifier, and ii) a second compartment capable of holding a packaged desiccant;

c) at least one humidifier that is capable of being inserted within said compartment;

d) at least one packaged desiccant that is a compound that is capable of absorbing moisture from the internal environment of said storage apparatus, said packaged desiccant being held in a container which does not prevent said compound from removing moisture from the interior of said musical instrument carrying case;

e) a thermometer provided within said musical instrument carrying case such that said thermometer is capable of being read by said person while said musical instrument carrying case is closed and monitors an internal temperature within said musical instrument carrying case; and wherein said at least one humidifier and said at least one packaged desiccant can be inserted and removed from said first and second compartment respectively by a person to maintain a stable and desired relative humidity inside said musical instrument carrying case.

7. A storage apparatus for a musical instrument comprising:

a) a musical instrument carrying case; and b) a humidity control unit attached to an inner portion of said musical instrument carrying case, said humidity control unit including:

i) a first compartment capable of holding a humidifier, and ii) a second compartment capable of holding a packaged desiccant;

c) at least one humidifier that is capable of being inserted within said compartment;

d) at least one packaged desiccant that is a compound that is capable of absorbing moisture from the internal environment of said storage apparatus, said packaged desiccant being held in a container which does not prevent said compound from removing moisture from the interior of said musical instrument carrying case;

e) a thermometer provided within said musical instrument carrying case such that said thermometer is capable of being read by said person while said musical instrument carrying case is open and monitors an internal temperature within said musical instrument carrying case; and wherein said at least one humidifier and said at least one packaged desiccant can be inserted and removed from said first and second compartment respectively by a person to maintain a stable and desired relative humidity inside said musical instrument carrying case.

* * * * *